US009347680B2

(12) United States Patent
Zhang

(10) Patent No.: US 9,347,680 B2
(45) Date of Patent: May 24, 2016

(54) MOVING DEVICE AND DUST COVER

(71) Applicant: Shenzhen China Star Optoelectronics Technology Co., Ltd., Shenzhen, Guangdong (CN)

(72) Inventor: Xindi Zhang, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 676 days.

(21) Appl. No.: 13/704,981

(22) PCT Filed: Dec. 5, 2012

(86) PCT No.: PCT/CN2012/085964

§ 371 (c)(1),
(2) Date: Dec. 17, 2012

(87) PCT Pub. No.: WO2014/079106

PCT Pub. Date: May 30, 2014

(65) Prior Publication Data

US 2014/0148089 A1 May 29, 2014

(30) Foreign Application Priority Data

Nov. 23, 2012 (CN) ..... 2012 1 0480775

(51) Int. Cl.
*F24F 13/06* (2006.01)
*F24F 13/20* (2006.01)
*F24F 3/16* (2006.01)

(52) U.S. Cl.
CPC ..... *F24F 13/20* (2013.01); *F24F 3/1603* (2013.01)

(58) Field of Classification Search
CPC ..... F24F 13/06; F24F 7/007; F24F 13/20; F24F 3/1603
USPC ..... 454/49, 81, 187, 237, 251, 275, 370, 454/135, 160; 55/385.1, 272, 238; 96/11; 359/296; 428/411; 472/78
See application file for complete search history.

(56) References Cited

U.S. PATENT DOCUMENTS

| | | | | |
|---|---|---|---|---|
| 3,766,844 A * | 10/1973 | Donnelly | F24F 3/1603 | 135/116 |
| 6,508,850 B1 * | 1/2003 | Kotliar | A61G 10/005 | 128/205.11 |
| 7,549,431 B1 * | 6/2009 | Farnworth | A62B 31/00 | 135/115 |
| 2005/0194104 A1 * | 9/2005 | Nien | E06B 9/262 | 160/84.05 |
| 2006/0283562 A1 * | 12/2006 | Hickey | E04G 21/30 | 160/180 |

FOREIGN PATENT DOCUMENTS

| | | | |
|---|---|---|---|
| CN | 101271836 | A | 9/2008 |
| CN | 202245207 | U | 5/2012 |
| CN | 2665206 | Y | 12/2012 |
| JP | 2003325677 | A | 11/2003 |

* cited by examiner

*Primary Examiner* — Gregory Huson
*Assistant Examiner* — Dana Tighe
(74) *Attorney, Agent, or Firm* — Andrew C. Cheng

(57) ABSTRACT

The present invention provides a moving device and dust cover. The moving device includes a moving cart and a dust cover; the dust cover forming a dust-prevention space over the moving cart; the dust cover including an air-driver device, a vent tube and an outer cover; the air-driver device being disposed outside of outer cover for sucking in outside air and driving air into vent tube; the vent tube being connected to air-driver device and outer cover, for flowing of the air sucked in by air-driver device into the dust-prevention space formed by outer cover so that the space forming a positive pressure with respect to outside of outer cover; the outer cover performing filtering on the air flown in through vent tube. As such, the present invention accomplishes a better cleanroom result and provides easy disassembly and flexible usability to reduce the cost.

9 Claims, 5 Drawing Sheets

MOVING DEVICE AND DUST COVER

BACKGROUND OF THE INVENTION

1. Field of the Invention

The present invention relates to the field of moving and dust prevention techniques, and in particular to a moving device and dust cover.

2. The Related Arts

In the assembly line production in a factory, may processes involve moving object in a cleanroom environment. The cleanroom environment is to stay isolated from the small particles in the outside air and to guarantee the stable airflow and pressure in the inside operation space to form a production environment.

In known technique, the provided cleanroom moving device is usually formed by adding a air filter unit in a generic moving cart, and the moving cart and the air filter unit are integrated. The air filter unit is a modular terminal air blowing device with the filtering function. The moving cart equipped with air filter unit is often more bulky, requires a larger space, is less flexible and costs more. When malfunctioning, that is, not meeting the requirements of cleanroom standard, the entire moving cart with air filter unit must be replaced, which results in even higher manufacturing cost.

SUMMARY OF THE INVENTION

The technical issue to be addressed by the present invention is to provide a moving device and a dust cover, able to accomplish better dust-prevention result for moving device, having the advantages of ease disassembly, flexible usability and low cost.

The present invention provides a moving device, which comprises: a moving cart and a dust cover; the dust cover forming a dust-prevention space; the dust cover comprising: an air-driver device, a vent tube and an outer cover; the air-driver device being disposed outside of the outer cover for sucking in outside air and driving the air into the vent tube; the vent tube being connected to the air-driver device and the outer cover, for flowing of the air sucked in by the air-driver device into the dust-prevention space formed by the outer cover so that the space forming a positive pressure with respect to outside of the outer cover; the vent tube being a soft tube; the outer cover preventing inside from contacting the outside air except through the vent tube, and performing filtering on the air flown in through the vent tube, the outer cover comprising a support frame and a soft cover, the support frame forming a rectangle disposed at top of the dust-prevention space and supporting the soft cover.

According to a preferred embodiment of the present invention, the dust-prevention space supported by the support frame is cubic, each top side of the cube structure is disposed with a corresponding scroll. the scroll is located at the top side of the cube when rolls up, and located at the bottom side of the cube when rolls down; the scroll has a same length as the top side; the soft cover comprises a first cover part corresponding to the top of the cube structure and four second cover parts, with each second cover part as the scroll corresponding respectively to an outer side of the cube structure; each second cover part is connected at top with the side the first cover part, and the bottom of the second cover part is the axis of the scroll.

According to a preferred embodiment of the present invention, the support frame is made of aluminum extrusion.

According to a preferred embodiment of the present invention, the second cover part comprises a first layer, a second layer and a third layer; the first layer is disposed as the outermost layer and is disposed with a vent opening for connecting the vent tube; the second layer is disposed as the next outer layer and is disposed with filtering material; the third layer is disposed as the innermost layer and is disposed with tiny holes uniformly distributed.

According to a preferred embodiment of the present invention, the first layer and the third layer are made of plastic film.

According to a preferred embodiment of the present invention, the dust cover further comprises a tube interface, disposed between one end of the vent tube and the first layer, for fixing the vent tube and embeddedly connected to the first layer through the vent opening.

The present invention provides a moving device, which comprises: a moving cart and a dust cover; the dust cover forming a dust-prevention space; the dust cover comprising: an air-driver device, a vent tube and an outer cover; the air-driver device being disposed outside of the outer cover for sucking in outside air and driving the air into the vent tube; the vent tube being connected to the air-driver device and the outer cover, for flowing of the air sucked in by the air-driver device into the dust-prevention space formed by the outer cover so that the space forming a positive pressure with respect to outside of the outer cover; the outer cover preventing inside from contacting the outside air except through the vent tube, and performing filtering on the air flown in through the vent tube.

According to a preferred embodiment of the present invention, the outer cover comprises a support frame and a soft cover, the support frame forming a rectangle disposed at top of the dust-prevention space and supporting the soft cover.

According to a preferred embodiment of the present invention, the dust-prevention space supported by the support frame is cubic, each top side of the cube structure is disposed with a corresponding scroll, the scroll is located at the top side of the cube when rolls up, and located at the bottom side of the cube when rolls down; the scroll has a same length as the top side; the soft cover comprises a first cover part corresponding to the top of the cube structure and four second cover parts, with each second cover part as the scroll corresponding respectively to an outer side of the cube structure; each second cover part is connected at top with the side the first cover part, and the bottom of the second cover part is the axis of the scroll.

According to a preferred embodiment of the present invention, the support frame is made of aluminum extrusion.

According to a preferred embodiment of the present invention, the second cover part comprises a first layer, a second layer and a third layer; the first layer is disposed as the outermost layer and is disposed with a vent opening for connecting the vent tube; the second layer is disposed as the next outer layer and is disposed with filtering material; the third layer is disposed as the innermost layer and is disposed with tiny holes uniformly distributed.

According to a preferred embodiment of the present invention, the first layer and the third layer are made of plastic film.

According to a preferred embodiment of the present invention, the dust cover further comprises a tube interface, disposed between one end of the vent tube and the first layer, for fixing the vent tube and embeddedly connected to the first layer through the vent opening.

According to a preferred embodiment of the present invention, the vent tube is a soft tube, The present invention provides a dust cover, which comprises: an air-driver device, a vent tube and an outer cover; the air-driver device being disposed outside of the outer cover for sucking in outside air and driving the air into the vent tube; the vent tube being connected to the air-driver device and the outer cover, for flowing of the air sucked in by the air-driver device into the dust-prevention space formed by the outer cover so that the space forming a positive pressure with respect to outside of the outer cover; the outer cover preventing inside from contacting the outside air except through the vent tube, and performing filtering on the air flown in through the vent tube.

According to a preferred embodiment of the present invention, the outer cover comprises a support frame and a soft cover, the support frame forming a rectangle disposed at top of the dust-prevention space and supporting the soft cover; a dust-prevention space supported by the support frame is cubic, each top side of the cube structure is disposed with a corresponding scroll, the scroll is located at the top side of the cube when rolls up, and located at the bottom side of the cube when rolls down; the scroll has a same length as the top side: the soft cover comprises a first cover part corresponding to the top of the cube structure and four second cover parts, with each second cover part as the scroll corresponding respectively to an outer side of the cube structure; each second cover part is connected at top with the side the first cover part, and the bottom of the second cover part is the axis of the scroll; the second cover part comprises a first layer, a second layer and a third layer; the first layer is disposed as the outermost layer and is disposed with a vent opening for connecting the vent tube; the second layer is disposed as the next outer layer and is disposed with filtering material; the third layer is disposed as the innermost layer and is disposed with tiny holes uniformly distributed; the first layer and the third layer are made of plastic film.

The efficacy of the present invention is that to be distinguished from the state of the art. The present invention forms a dust-prevention space by placing a dust cover for the moving device over a moving cart. Through disposing an air-driver device outside the dust cover to suck in outside air and flow the air into the dust-prevention space through a vent tube, the present invention forms an inside positive pressure with respect to the outside. In addition, the dust cover filters the air flowing through the vent tube so that the moving device can accomplish a better cleanroom result. The present invention also provides easy disassembly and flexible usability to reduce the cost.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

Figure 1:
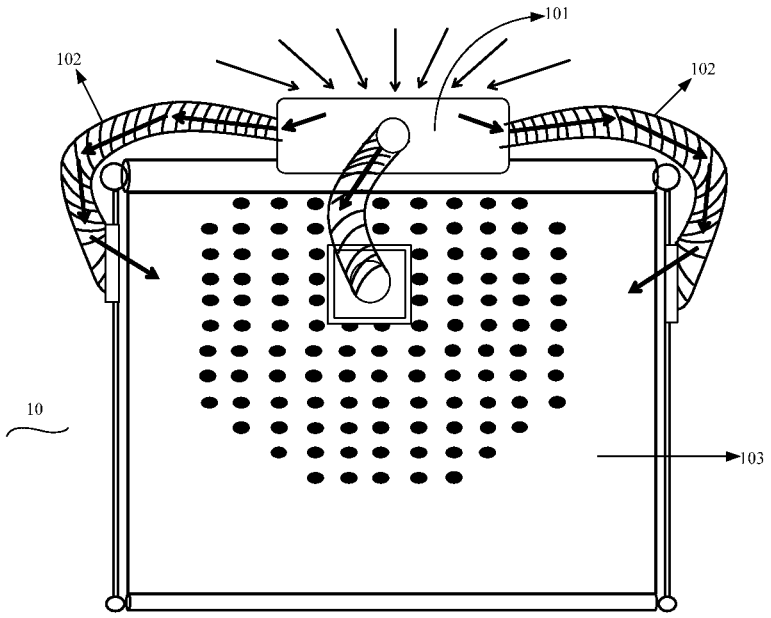
FIG. 1 is a schematic view showing the structure of a dust cover of an embodiment of a moving device according to the present invention.

The following provides a clear and complete description of the technical solution according to the present invention using the drawing and the embodiment. Apparently, the drawings described below show only example embodiments of the present invention, instead of all embodiments. For other embodiments based on the disclosed drawings and embodiments, and obtained by those having ordinary skills in the art without paying any creative effort are also within the scope of the present invention.

Figure 2:
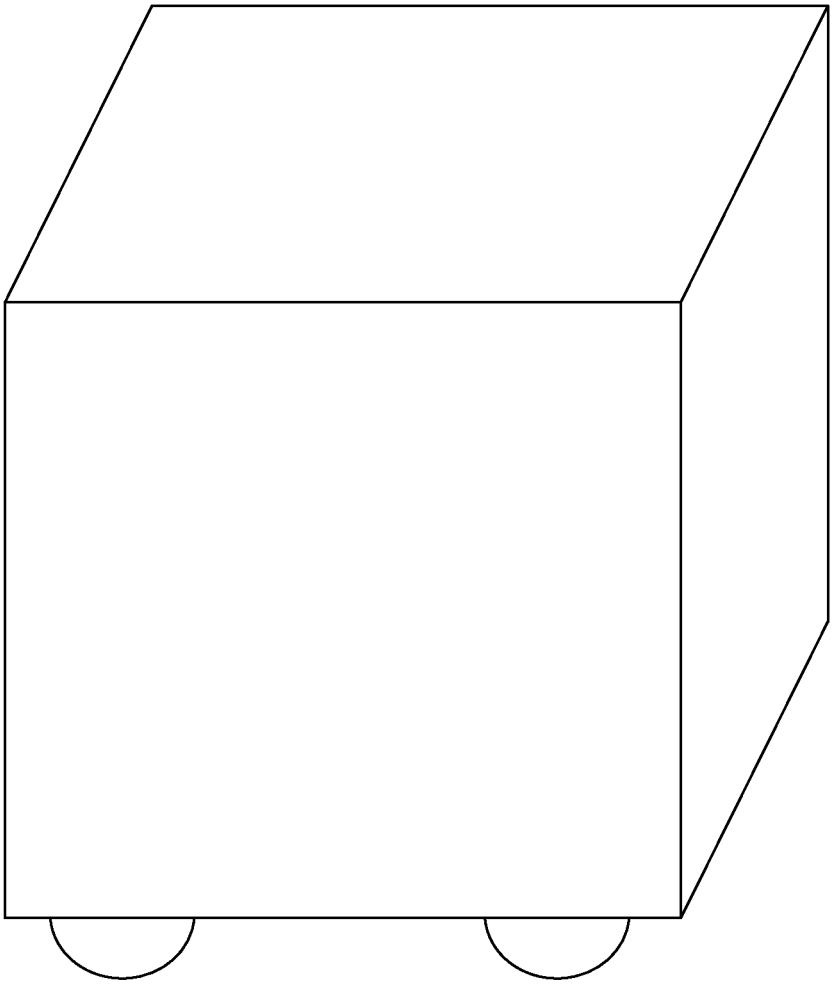
FIG. 2 is a schematic view showing the moving cart of an embodiment of a moving device according to the present invention.

Referring to FIGS. 1-2, FIG. 1 is a schematic view showing the structure of a dust cover of an embodiment of a moving device according to the present invention: FIG. 2 is a schematic view showing the moving cart of an embodiment of a moving device according to the present invention. The moving device of the present invention comprises a dust cover 10 and a moving cart 20. The dust cover 10 forms a dust-prevention space over the moving cart 20. The dust cover comprises: an air-driver device 101, a vent tube 102 and an outer cover 103.

The dust cover 10 and the moving cart 20 can be easily disassembled. For using, the dust cover 10 is placed to cover the moving cart 20. When not in use, the dust cover 10 can be removed from the moving cart 20.

The air-driver device 101 is disposed outside of the outer cover 103 for sucking in air outside of the outer cover 103 and driving the air into the vent tube 102. The air-driver device 101 continuously sucks in the air and sends the air into the vent tube 102, and the air flow speed can be adjusted according to the actual application. The air-driver device 101 can be any fan, exhaust fan or blower. In the instant embodiment, the power for the air-driver device 101 is supplied by the moving cart without any additional dedicated power supply device.

The vent tube 102 is connected to the air-driver device 101 and the outer cover 103 for flowing of the air sucked in by the air-driver device 101 into the dust-prevention space formed by the outer cover 103 so that the space forming a positive pressure inside the outer cover 103 with respect to outside of the outer cover 103. The positive pressure is a pressure higher than the normal pressure, i.e., the atmosphere. The formation of positive pressure inside the outer cover 103 makes the air flows in a direct from inside of the outer cover 103 towards outside of the outer cover 103, and the air cannot enters the outer cover 103 without passing through the vent tube 102. As such, the air inside the outer cover 102 is from the same origin to avoid dust from entering the outer cover 103. The vent tube 102 is a soft tube, which is light weighted, low cost, and convenient to use.

The outer cover 103 prevents inside from contacting the outside air except through the vent tube 102, and performs filtering on the air flown in through the vent tube 102. The outer cover 103 only allows the outside air to flow in at the part connecting the vent tube 102. The rest blocks contacting the outside air and performs filtering on the air at the part connecting the vent tube 102.

It should be understood that the dust cover for the moving device according to the present invention forms a dust-prevention space by placing a dust cover for the moving device over a moving cart. Through disposing an air-driver device outside the dust cover to suck in outside air and flow the air into the dust-prevention space through a vent tube, the present invention forms an inside positive pressure with respect to the outside. In addition, the dust cover filters the air flowing through the vent tube so that the moving device can accomplish a better cleanroom result. The present invention also provides easy disassembly and flexible usability to reduce the cost.

Figure 3:
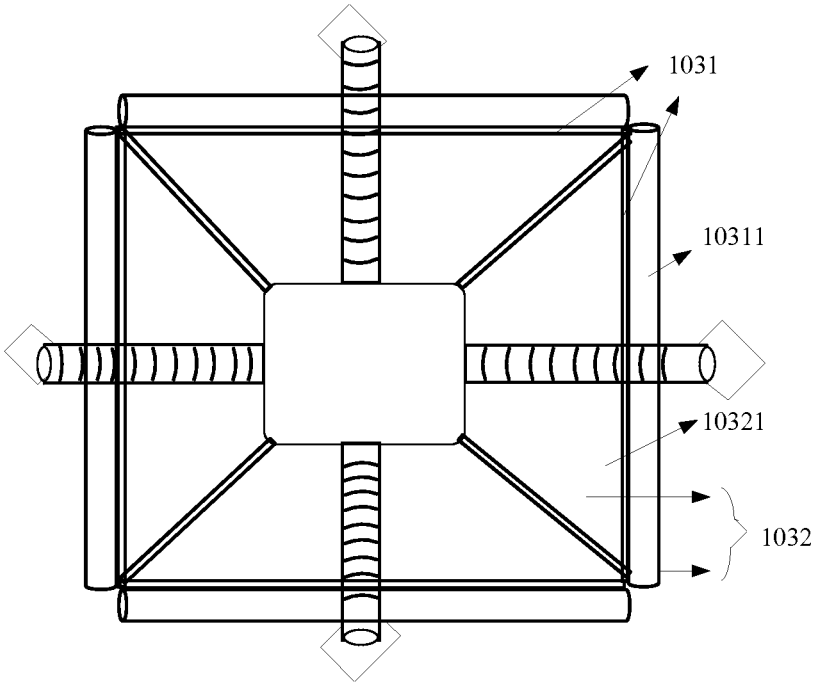
FIG. 3 is a top view showing the structure of a dust cover of an embodiment of a moving device according to the present invention.

Referring to FIG. 3, FIG. 3 is a top view showing the structure of a dust cover of an embodiment of a moving device according to the present invention. The outer cover 103 comprises a support frame 1031 and a soft cover 1032. The support frame 1031 forms a rectangle disposed at top of the dust-prevention space and supports the soft cover 1032. In other words, the support frame 1031 supports the soft cover 1032 to form the dust-prevention space of a cubic structure.

Figure 4:
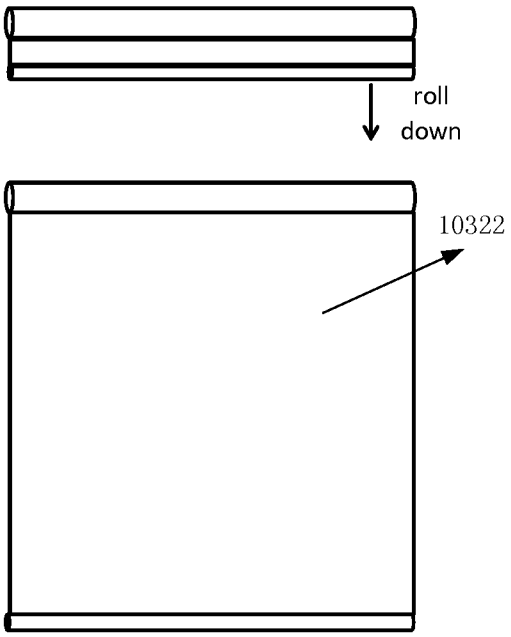
FIG. 4 is a schematic view of the soft cover of an embodiment of the dust cover with one side of the second cover rolled down according to the present invention.

Each top side of the cube structure is disposed with a corresponding scroll 10311. The scroll 10311 is located at the top side of the cube when rolls up so that the dust cover 10 will not occupy much space. The scroll 10311 is located at the bottom side of the cube when rolls down. The scroll 10311 has a same length as the top side so that only a very limited gap will exist between two adjacent scrolls 10311 when rolling down to maintain the stability of the airflow from inside of the outer cover 103 towards the outside of the outer cover 103. The length and width of the rectangle formed by the support frame 1031 correspond to the length of each scroll 10311 disposed at each side so that the soft cover 1032 supported by the support frame 1031 can be placed over the moving cart 20, The support frame 1031 is made of aluminum extrusion, which is light-weight and convenient for use Referring to FIG. 4, the soft cover 1032 comprises a first cover part 10321 corresponding to the top of the cube structure and four second cover parts 10322, with each second cover part 10322 as the scroll 10311 corresponding respectively to an outer side of the cube structure. The first cover part 10321 and the second cover part 10322 can be connected directly or through other structure. No specific restriction is imposed here.

Figure 5:
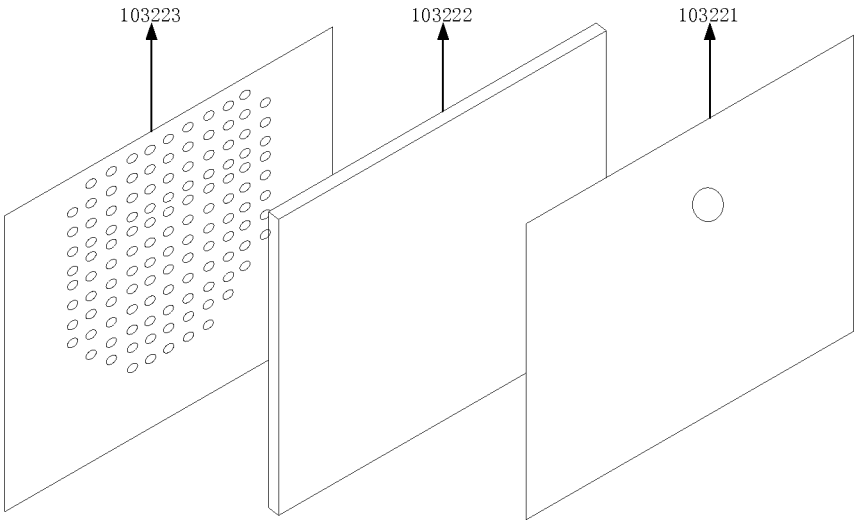
FIG. 5 is a exploded view of the second cover of the soft cover of an embodiment of the dust cover according to the present invention.

Referring to FIG. 5, the second cover part 10322 comprises a first layer 103221, a second layer 103222 and a third layer 103223. The first layer 103221 and the third layer 103223 are made of plastic film to reduce the manufacturing cost of the dust cover 10. The first layer 103221 is disposed as the outermost layer and is disposed with a vent opening for connecting the vent tube 102. The second layer 10322 is disposed as the next outer layer and is disposed with filtering material. The filtering material can be nonwoven fabric, chemical fiber materials, glass fiber material, and so on. The part of the second layer 103222 filled with filtering material faces the vent opening of the first layer 103221 so that the air from the vent tube 102 can be filtered. The filtered air enters the space between the second layer 103222 and the third layer 103223.

After filtering of the second layer 103222, the air still possesses the momentum of flow, which leads to unstable airflow and pressure inside. Therefore, the third layer 103223 is disposed as the innermost layer and is disposed with tiny holes uniformly distributed so that the air passing through the tiny holes will be stable to enter the innermost space in the cubic structure to maintain the stable airflow and pressure inside. The product is placed inside the innermost space for cleanroom condition transportation. In addition, the number of layers on the four sides of the soft cover 1032 is not necessarily identical, and depends on the number of the vent tube 102 on each side. For example, one side has only a vent tube 102, the side can be disposed with a three-layer structure, such as the first layer 103221, the second layer 103222 and the third layer 103223. Another side has two or more vent tubes 102, the number of second layers 103222 and the number of third layers 103223 can be optionally increased correspondingly to maintain the stable airflow and pressure inside. When another has no vent tube 102, no second layer 103222 and third layer 103223 is required. The choice depends on the actual application and no specific restriction is imposed here.

Figure 6:
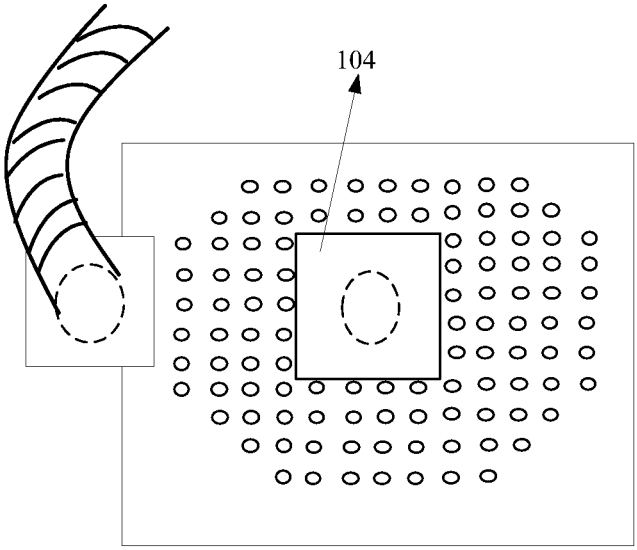
FIG. 6 shows a schematic view before the tube interface embeddedly connected to the first layer according to the present invention.
Figure 7:
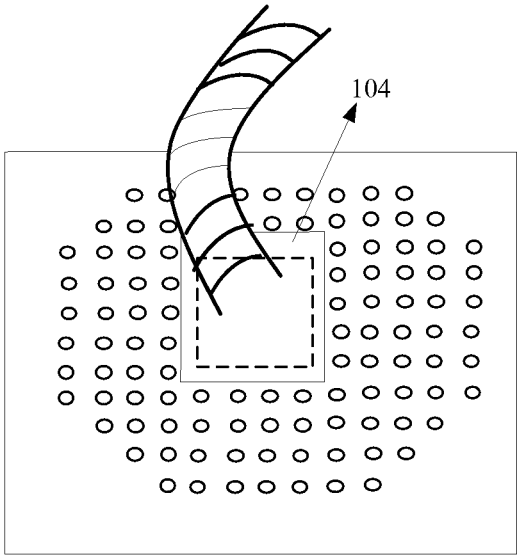
FIG. 7 is shows a schematic view of the tube interface embeddedly connected to the first layer according to the present invention.

Referring to FIGS. 6-7, FIG. 6 shows a schematic view before the tube interface embeddedly connected to the first layer according to the present invention; and FIG. 7 shows a schematic view of the tube interface embeddedly connected to the first layer according to the present invention. A tube interface 104 is disposed between one end of the vent tube 102 and the first layer 103221, for fixing the vent tube 102 and embeddedly connected to the first layer 103221 through the vent opening. However, the connection is not restricted to the use of tube interface 104 to fix the vent tube 102 and first layer 103221. Other means able to fix the vent tube 102 and connect to first layer 103221 can be used in actual applications.

In summary, the dust cover for the moving device of the present invention is placed over the moving cart to form dust-prevention space and is convenient for disassembly. Through disposing an air-driver device outside the dust cover to suck in outside air and flow the air into the dust-prevention space through a vent tube, the present invention forms an inside positive pressure with respect to the outside. In addition, the outer cover comprises three layers, with the first layer separating the outside, the second layer filtering the air and the third stabilizing the airflow, so that the moving device can accomplish a better cleanroom result and reduce the cost for cleanroom transportation.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the clams of the present invention.

What is claimed is:

1. A moving device, which comprises: a moving cart and a dust cover; the dust cover forming a dust-prevention space; the dust cover comprising: an air-driver device, a vent tube and an outer cover;

the air-driver device being disposed outside of the outer cover for sucking in outside air and driving the air into the vent tube;

the vent tube being connected to the air-driver device and the outer cover, for flowing of the air sucked in by the air-driver device into the dust-prevention space formed by the outer cover so that the space forming a positive pressure with respect to outside of the outer cover; the vent tube being a soft tube; and the outer cover preventing inside from contacting the outside air except through the vent tube, and performing filtering on the air flown in through the vent tube, the outer cover comprising a support frame and a soft cover, the support frame forming a rectangle disposed at top of the dust-prevention space and supporting the soft cover, wherein, the dust-prevention space supported by the support frame is cubic, each side of a top of the cube structure is disposed with a corresponding scroll, the scroll is located at the side of the top of the cube structure when the scroll rolls up, and located at the bottom side of the cube structure when the scroll rolls down; the scroll has a same length as the side of the top of the cube structure; the soft cover comprises a first cover part corresponding to the top of the cube structure and four second cover parts, with each second cover part as the scroll corresponding respectively to an outer side of the cube structure; each second cover part is connected at top with the side of the first cover part, and the bottom of the second cover part is the axis of the scroll, wherein, the second cover part comprises a first layer, a second layer and a third layer;

the first layer is disposed as the outermost layer and is disposed with a vent opening for connecting the vent tube;

the second layer is disposed as the next outer layer and is disposed with filtering material; and the third layer is disposed as the innermost layer and is disposed with tiny holes uniformly distributed, wherein a part of the second layer is filled with the filtering material.

2. The moving device as claimed in claim 1, characterized in that the support frame is made of aluminum extrusion.

3. The moving device as claimed in claim 1, characterized in that the first layer and the third layer are made of plastic film.

4. The moving device as claimed in claim 1, characterized in that the dust cover further comprises a tube interface, disposed between one end of the vent tube and the first layer, for fixing the vent tube and embeddedly connected to the first layer through the vent opening.

5. A moving device, which comprises: a moving cart and a dust cover; the dust cover forming a dust-prevention space; the dust cover comprising: an air-driver device, a vent tube and an outer cover;

the air-driver device being disposed outside of the outer cover for sucking in outside air and driving the air into the vent tube;

the vent tube being connected to the air-driver device and the outer cover, for flowing of the air sucked in by the air-driver device into the dust-prevention space formed by the outer cover so that the space forming a positive pressure with respect to outside of the outer cover;

the outer cover preventing inside from contacting the outside air except through the vent tube, and performing filtering on the air flown in through the vent tube, wherein, the outer cover comprises a support frame and a soft cover, the support frame forming a rectangle disposed at top of the dust-prevention space and supporting the soft cover;

wherein, the dust-prevention space supported by the support frame is cubic, each side of a top of the cube structure is disposed with a corresponding scroll, the scroll is located at the side of the top of the cube structure when the scroll rolls up, and located at the bottom side of the cube structure when the scroll rolls down; the scroll has a same length as the side of the top of the cube structure; the soft cover comprises a first cover part corresponding to the top of the cube structure and four second cover parts, with each second cover part as the scroll corresponding respectively to an outer side of the cube structure; each second cover part is connected at top with the side of the first cover part, and the bottom of the second cover part is the axis of the scroll, wherein, the second cover part comprises a first layer, a second layer and a third layer;

the first layer is disposed as the outermost layer and is disposed with a vent opening for connecting the vent tube;

the second layer is disposed as the next outer layer and is disposed with filtering material; and the third layer is disposed as the innermost layer and is disposed with tiny holes uniformly distributed, wherein a part of the second layer is filled with the filtering material.

6. The moving device as claimed in claim 5, characterized in that the support frame is made of aluminum extrusion.

7. The moving device as claimed in claim 5, characterized in that the first layer and the third layer are made of plastic film.

8. The moving device as claimed in claim 5, characterized in that the dust cover further comprises a tube interface, disposed between one end of the vent tube and the first layer, for fixing the vent tube and embeddedly connected to the first layer through the vent opening.

9. A dust cover, which comprises: an air-driver device, a vent tube and an outer cover:

the air-driver device being disposed outside of the outer cover for sucking in outside air and driving the air into the vent tube;

the vent tube being connected to the air-driver device and the outer cover, for flowing of the air sucked in by the air-driver device into the dust-prevention space formed by the outer cover so that the space forming a positive pressure with respect to outside of the outer cover;

the outer cover preventing inside from contacting the outside air except through the vent tube, and performing filtering on the air flown in through the vent tube, wherein, the outer cover comprises a support frame and a soft cover, the support frame forming a rectangle disposed at top of the dust-prevention space and supporting the soft cover; a dust-prevention space supported by the support frame is cubic, each side of top of the cube structure is disposed with a corresponding scroll, the scroll is located at the side of the top of the cube structure when the scroll rolls up, and located at the bottom side of the cube structure when the scroll rolls down; the scroll has a same length as the side of the top of the cube structure; the soft cover comprises a first cover part corresponding to the top of the cube structure and four second cover parts, with each second cover part as the scroll corresponding respectively to an outer side of the cube structure; each second cover part is connected at top with the side of the first cover part, and the bottom of the second cover part is the axis of the scroll; the second cover part comprises a first layer, a second layer and a third layer; the first layer is disposed as the outermost layer and is disposed with a vent opening for connecting the vent tube; the second layer is disposed as the next outer layer and is disposed with filtering material; the third layer is disposed as the innermost layer and is disposed with tiny holes uniformly distributed; the first layer and the third layer are made of plastic film, wherein a part of the second layer is filled with the filtering material.

* * * * *